US009707473B1

(12) United States Patent
Tseng

(10) Patent No.: US 9,707,473 B1
(45) Date of Patent: Jul. 18, 2017

(54) STACKING DEVICE FOR MAHJONG TILES

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 0 days.

(21) Appl. No.: 15/253,876

(22) Filed: Sep. 1, 2016

(51) Int. Cl.
*A63B 71/00* (2006.01)
*A63F 9/20* (2006.01)

(52) U.S. Cl.
CPC ..... *A63F 9/20* (2013.01); *A63F 2009/205* (2013.01)

(58) Field of Classification Search
CPC ..... A63F 1/06
USPC ..... 273/148 R
See application file for complete search history.

(56) References Cited

U.S. PATENT DOCUMENTS 3,315,785 A * 4/1967 Shiffer ..... B65G 49/085 198/369.5
4,219,200 A * 8/1980 Takahashi ..... A63F 9/28 273/149 R
4,534,561 A * 8/1985 Okuno ..... A63F 9/28 273/149 R
6,113,100 A * 9/2000 Mu ..... A63F 9/28 273/149 R
6,361,044 B1 * 3/2002 Block ..... A63F 1/14 273/148 R
7,222,852 B2 * 5/2007 Soltys ..... A63F 1/18 273/148 R
8,366,111 B2 * 2/2013 Factor ..... A63F 1/04 273/292
8,672,329 B2 * 3/2014 Wang ..... A63F 9/20 273/144 A
8,814,456 B2 * 8/2014 Schultz ..... B65D 83/0022 222/471
8,892,244 B1 * 11/2014 Taylor ..... B25J 9/1687 156/64
2010/0175943 A1 * 7/2010 Bergmann ..... H02K 41/03 180/168
2012/0326388 A1 * 12/2012 Wang ..... A63F 9/20 273/148 R
2013/0001875 A1 * 1/2013 Wang ..... A63F 9/20 273/237

* cited by examiner

*Primary Examiner* — Aarti B Berdichevsky
*Assistant Examiner* — Dolores Collins
(74) *Attorney, Agent, or Firm* — Raymond Y. Chan; David and Raymond Patent Firm

(57) ABSTRACT

A stacking device for mahjong tiles includes a main frame, a link rod, a side frame, and a lift seat. The main frame is coupled with a turning wheel having a guide trough. The guide trough has an annular indentation section. The link rod has a retaining pivot portion, a link pivot portion, and a guide roller pivot portion pivotally connected with a first guide roller. The first guide roller is located in the guide trough. The side frame is provided with two rails. The rails are provided with a slide seat connected with a push board. The slide seat has a slide groove. The turning wheel can bring the slide seat to displace. The lift seat includes a platform and a slide board beneath the platform. The link pivot portion is pivotally connected to a lower end of the slide board.

7 Claims, 7 Drawing Sheets

STACKING DEVICE FOR MAHJONG TILES

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a stacking device for mahjong tiles, and more particularly to a device able to stack mahjong tiles automatically for playing a game.

Description of Related Arts

Mahjong is a puzzle entertainment for all ages, which contains various changes. It is well known that Mahjong is one of the quintessence of Chinese culture. With the developments of technology and network, there are different mahjong games. During a variety of mahjong games, it is necessary to shuffle tiles, stack tiles, and deal tiles. In order to increase the fairness of the mahjong game and to prevent fraud, the players should reduce the chance of touching tiles. Therefore, a mahjong table able to shuffle, stack and retrieve tiles automatically is developed on the market. But, this mahjong table is only suitable to play a traditional mahjong game for four players to sit around the table. If the players want to play different mahjong games, it is necessary to stack every two of the mahjong tiles. There is no auxiliary product able to stack the mahjong tiles automatically, let alone to cooperate with electronic and computer games. Accordingly, the inventor of the present invention has devoted himself based on his many years of practical experiences to solve this problem.

SUMMARY OF THE PRESENT INVENTION

The primary object of the present invention is to solve the foregoing problems and to provide a stacking device for mahjong tiles. Every two of the mahjong tiles inputted externally are stacked up by a lift seat, and then the stacked mahjong tiles are pushed outward for playing a game. The tiles can be stacked automatically to decrease human intervention.

DETAILED DESCRIPTION OF THE PREFERRED EMBODIMENT

Figure 1:
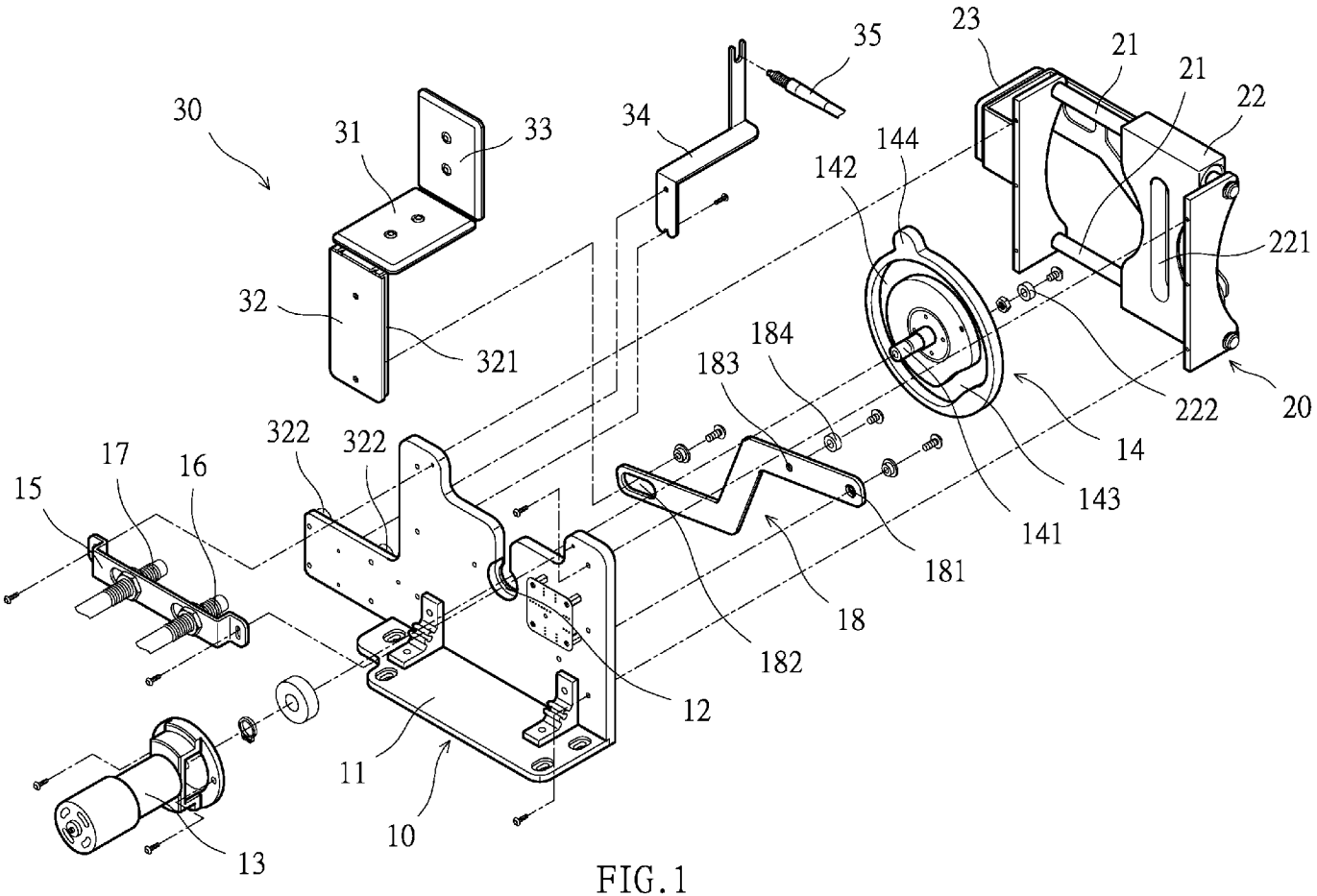
FIG. 1 is an exploded view of the present invention.
Figure 2:
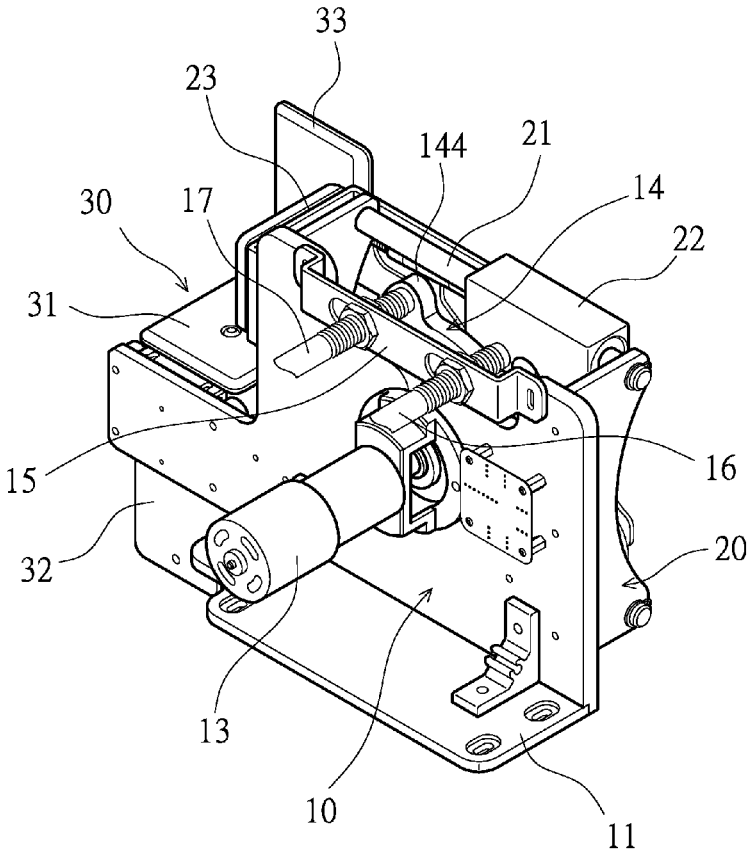
FIG. 2 is a perspective view of the present invention.
Figure 3:
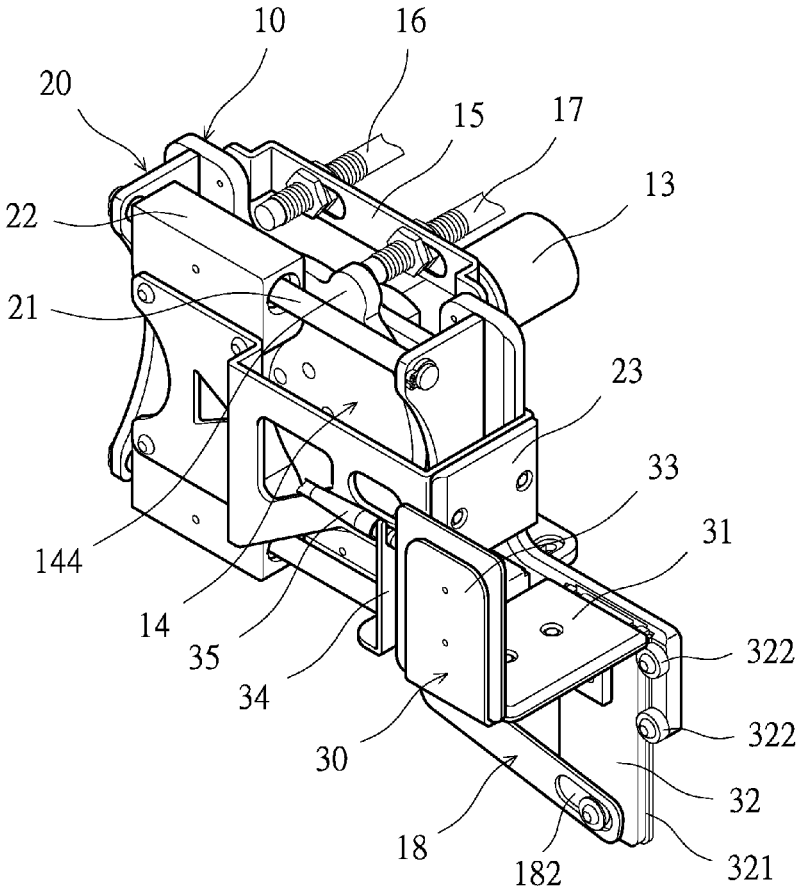
FIG. 3 is another perspective view of the present invention.

Embodiments of the present invention will now be described, by way of example only, with reference to the accompanying drawings.

As shown in FIG. 1 to FIG. 5, a stacking device for mahjong tiles of the present invention comprises a main frame 10, a link rod 18, a side frame 20, and a lift seat 30. The main frame 10 is an upright board. A bottom of the main frame 10 is provided with a horizontal fixing board 11. The fixing board 11 may be coupled on a machine platen. The main frame 10 is formed with a through hole 12. One side of the through hole 12 is provided with a motor 13. Another side of the through hole 12 is provided with a disk-shaped turning wheel 14 having a turning axle 141. The turning axle 141 passes the through hole 12 and is connected with a turning shaft of the motor 13, enabling the motor 13 to drive the turning wheel 14. One side of the turning wheel 14, facing the main frame 10, is formed with an annular guide trough 142. The guide trough 142 has an annular indentation section 143 having a shorter length in a radial direction. An outer rim of the turning wheel 14 is provided with an outer protrusion 144. The main frame 10 is coupled with a first fixing frame 15 having a first proximity switch 16 and a second proximity switch 17. The first proximity switch 16 and the second proximity switch 17 correspond to the outer protrusion 144 of the turning wheel 14, respectively. The link rod 18 is transversely disposed between the main frame 10 and the turning wheel 14. One end of the link rod 18 has a retaining pivot portion 181 and is pivotally connected to the main frame 10. Another end of the link rod 18 has a link pivot portion 182 in the form of a slot. The link rod 18 further has a guide roller pivot portion 183 between the retaining pivot portion 181 and the link pivot portion 182. The guide roller pivot portion 183 is pivotally connected with a first guide roller 184. The guide roller pivot portion 183 is disposed close to one side of the retaining pivot portion 181. The first guide roller 184 is located in the guide trough 142, enabling the first guide roller 184 to slide in the guide trough 142 when rotated and to bring the link rod 18 to swing up and down with the retaining pivot portion 181 as an axis. The side frame 20 is disposed at another side of the turning wheel 14 opposite the turning axle 141 and coupled to the main frame 10. Upper and lower ends of the side frame 20 are provided with two horizontal corresponding rails 21. The rails 21 are provided with a slide seat 22 connected with a push board 23. The slide seat 22 and the push board 23 are synchronously slid back and forth on the rails 21. One side of the slide seat 22, facing the turning wheel 14, is formed with a vertical slide groove 221. The turning wheel 14 is pivotally connected with a second guide roller 222. The second guide roller 222 is located in the slide groove 221. The second guide roller 222 can slide in the slide groove 221 along with rotation of the turning wheel 14 to bring the slide seat 22 to displace horizontally. The lift seat 30 is disposed at a distal end of the push board 23. The lift seat 30 includes a horizontal platform 31 and a vertical slide board 32 at one side of the platform 31 to extend downward. Two sides of the slide board 32 are formed with rail troughs 321. A vertical side board 33 is provided at one side of the platform 31 to extend upward. The slide board 32 and the side board 33 can be at the same side or opposing sides of the platform 31. One side of the main frame 10 is provided with a plurality of rail rollers 322 arranged in left and right rows, such that the rail troughs 321 of the slide board 32 are engaged between the left and right rows of the rail rollers 322. The link pivot portion 182 is pivotally connected to a lower end of the slide board 32, such that the lift seat 30 is kept vertically on the rail rollers 322 to ascend and descend, and the push board 23 is moved back and forth above the platform 31. The main frame 10 is further coupled with a second fixing frame 34 having a fiber optic sensor 35. The fiber optic sensor 35 is located above the platform 31 of the lift seat 30. Through the aforesaid device, the outer protrusion 144 of the turning wheel 14 is turned to correspond in position to the first proximity switch 16, and the first guide roller 184 is located at an initial position at the annular indentation section 143 of the guide trough 142. The link rod 18 enables the lift seat 30 to ascend for a first mahjong tile 1 to be inputted externally. The outer protrusion 144 of the turning wheel 14 is further turned to correspond in position to the second proximity switch 17, and the first guide roller 184 is located in the annular guide trough 142, and the second guide roller 222 is vertically displaced in the slide groove 221. The link rod 18 enables the lift seat 30 to descend for a second mahjong tile 1 to be inputted externally. The second mahjong tile 1 is stacked on the first mahjong tile 1. The outer protrusion 144 of the turning wheel 14 is turned and returned from the position of the second proximity switch 17 to the initial position of the first proximity switch 16, such that the second guide roller 222 brings the slide seat 22 and the push board 23 to horizontally slide back and forth and push the stacked mahjong tiles 1 outside. The tiles can be stacked automatically to decrease human intervention.

The details of the assembly of the present invention are described as below. As shown in FIG. 1 to FIG. 7, the first guide roller 184 of the present invention is disposed at the lower portion of the turning wheel 14, so the annular guide trough 142 having a longer radial length will press the first guide roller 184 downward to move the lift seat 30 downward. The annular indention section 143 having a shorter radial length will push the first guide roller 184 upward to move the lift seat 30 upward. The link rod 18 is swung with the retaining pivot portion 181 as its axis to bring the lift seat 30 to ascend or descend. The link pivot portion 182 is curvedly swung up and down. The link pivot portion 182 is designed in the form of a slot, so that the link pivot portion 182 pivoted to the lower end of the slide board 32 and swung along with the link rod 18 has a space to change the position of its axis. The rotation of the turning wheel 14 uses a servo motor to calculate the turning angle to orientate the turning position of the turning wheel 14 or uses the first proximity switch 16 and the second proximity switch 17 to sense the outer protrusion 14 to orientate the turning position of the turning wheel 14, achieving a precise orientation effect.

Figure 4:
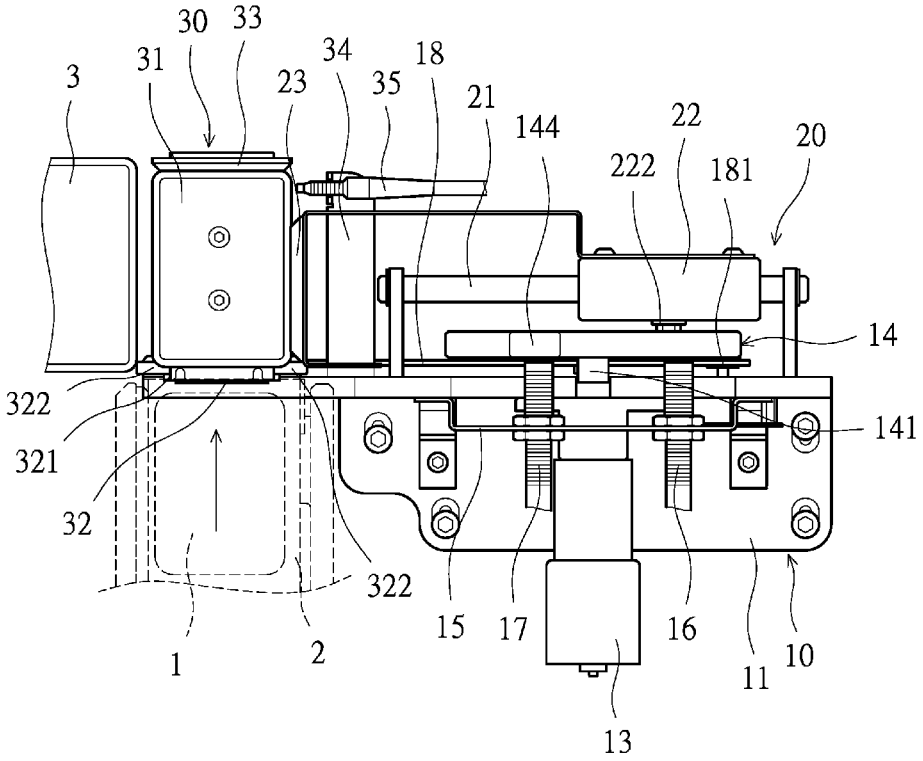
FIG. 4 is a top view of the present invention.
Figure 5:
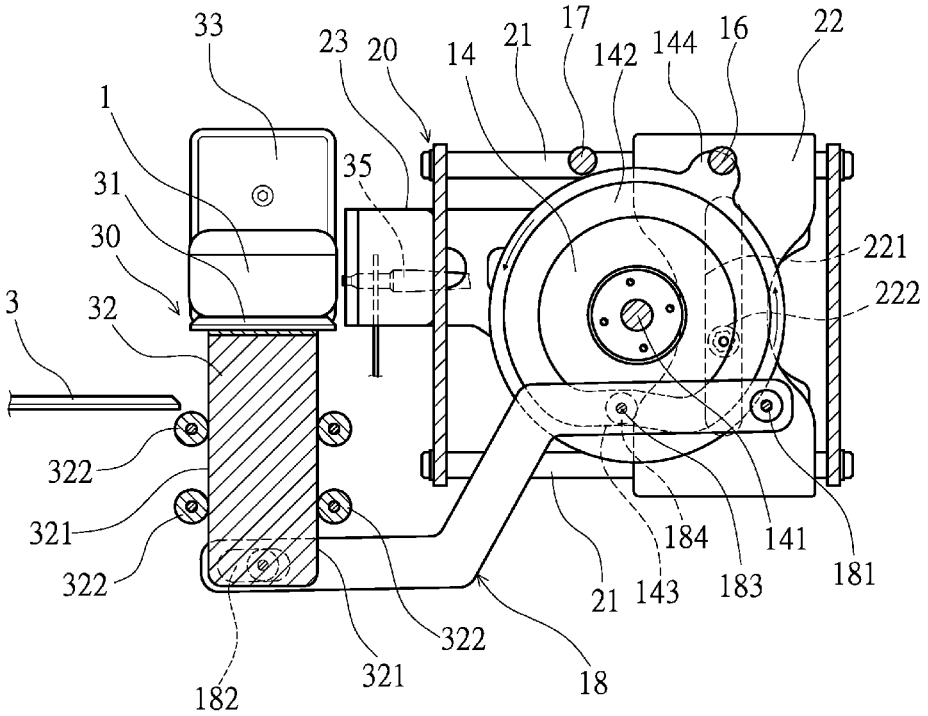
FIG. 5 is a side sectional view of the present invention, showing that the lift seat is ascended to input the first mahjong tile.
Figure 6:
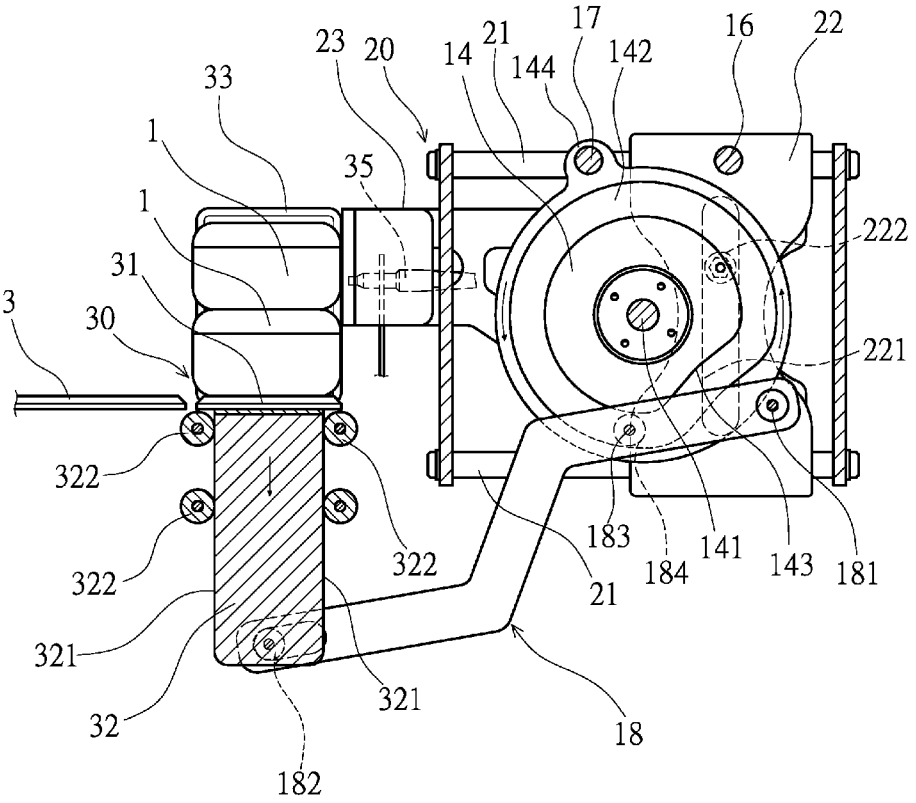
FIG. 6 is a side sectional view of the present invention, showing that the lift seat is descended to input the second mahjong tile.
Figure 7:
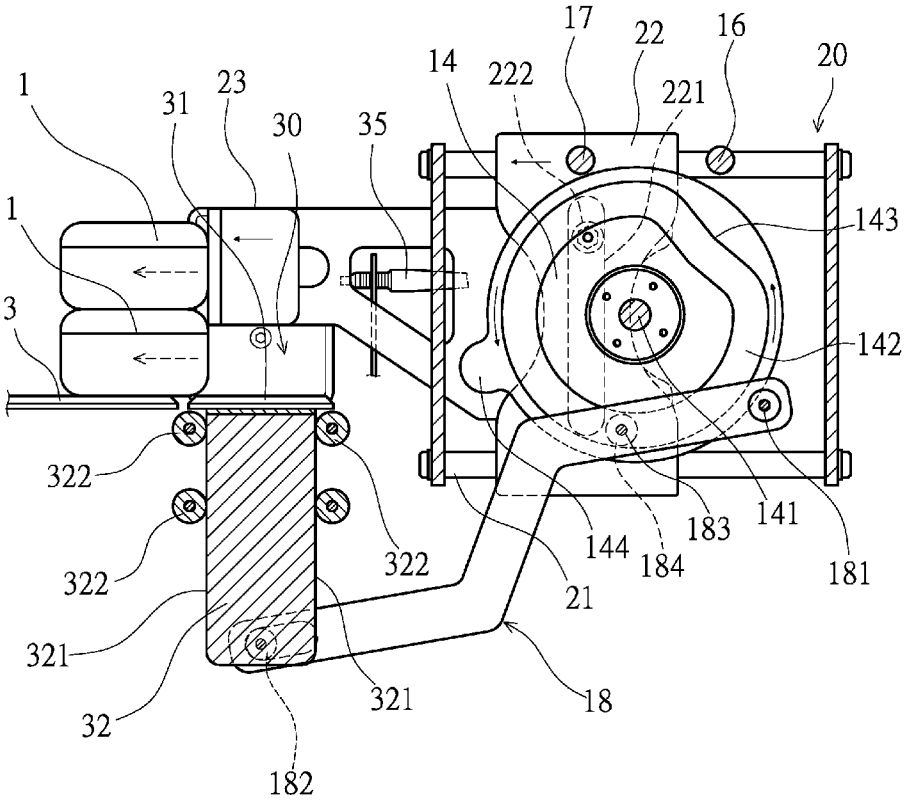
FIG. 7 is a side sectional view of the present invention, showing that the stacked mahjong tiles are pushed outward.

Referring to FIG. 1 to FIG. 7, when in use, in the beginning, the motor 13 drives the turning wheel 14 for the outer protrusion 144 to correspond in position to the first proximity switch 16. The first guide roller 184 is located at the annular indentation section 143 of the guide trough 142. The annular indention section 143 having a shorter radial length pushes the first guide roller 184 upward. As a result, the link pivot portion 182 at the distal end of the link rod 18 is swung upward, and the lift seat 30 is moved upward, and the platform 31 is level with an external conveying belt 2 which is used to deliver the mahjong tiles 1. After the lift seat 30 ascends and the first proximity switch 16 senses the outer protrusion 144, the conveying belt 2 delivers the first mahjong tile 1 to the platform 31, as shown in FIG. 4 and FIG. 5. Due to the inertia effect of the mahjong tile 1, the side board 33 can block the mahjong tile 1 to be positioned on the platform 31 exactly. When the fiber optic sensor 35 senses the first mahjong tile 1, the motor 13 drives the turning wheel 14 to turn once again for the outer protrusion 144 to correspond in position to the second proximity switch 17. The first guide roller 184 is located in the annular guide trough 142, and the second guide roller 222 is vertically displaced in the slide groove 221. The slide seat 22 is not moved obviously because the annular guide trough 142 has a longer radial length to press the first guide roller 184. Thus, the link pivot portion 182 at the distal end of the link rod 18 is swung downward to move the lift seat 30 downward, so that the platform 31 is level with an external receiving platform 3 and the top of the first mahjong tile 1 is level with the external conveying belt 2. After the lift seat 30 descends and the second proximity switch 17 senses the outer protrusion 144, the conveying belt 2 delivers the second mahjong tile 1 to be stacked on the first mahjong tile 1, as shown in FIG. 6. When the fiber optic sensor 35 senses the second mahjong tile 1, the motor 13 drives the turning wheel 14 to turn once again and the outer protrusion 144 is returned from the position of the second proximity switch 17 to the initial position of the first proximity switch 16. The second guide roller 222 horizontally slides back and forth to bring the slide seat 22 and the push board 23 to push the stacked mahjong tiles 1 forward to the receiving platform 3, and then the slide seat 22 and the push board 23 are homed, as shown in FIG. 7. Finally, the outer protrusion 144 is returned to the position of the first proximity switch 16, and the first guide roller 184 is located at the annular indentation section 143 of the guide trough 142. Therefore, the first guide roller 184 is ascended once again to move the lift seat 30 upward to be level with the conveying belt 2 again. The operation is repeatedly to output the stacked mahjong tiles 1 for playing a game. The tiles can be stacked automatically to decrease human intervention.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A stacking device for mahjong tiles, comprising a main frame, a link rod, a side frame, and a lift seat; the main frame being an upright board and having a through hole, one side of the through hole being provided with a motor, another side of the through hole being provided with a turning wheel having a turning axle, the turning axle passing the through hole and being connected with a turning shaft of the motor, enabling the motor to drive the turning wheel; one side of the turning wheel, facing the main frame, being formed with an annular guide trough, the guide trough having an annular indentation section having a shorter length in a radial direction, an outer rim of the turning wheel being provided with an outer protrusion; the main frame being coupled with a first fixing frame having a first proximity switch and a second proximity switch, the first proximity switch and the second proximity switch corresponding to the outer protrusion of the turning wheel respectively; the link rod being transversely disposed between the main frame and the turning wheel, one end of the link rod having a retaining pivot portion and being pivotally connected to the main frame, another end of the link rod having a link pivot portion, the link rod further having a guide roller pivot portion between the retaining pivot portion and the link pivot portion, the guide roller pivot portion being pivotally connected with a first guide roller, the first guide roller being located in the guide trough, enabling the first guide roller to slide in the guide trough and to bring the link rod to swing up and down with the retaining pivot portion as its axis; the side frame being disposed at another side of the turning wheel opposite the turning axle and coupled to the main frame, upper and lower ends of the side frame being provided with two horizontal corresponding rails, the rails being provided with a slide seat connected with a push board, the slide seat and the push board being synchronously slid back and forth on the rails; one side of the slide seat, facing the turning wheel, being formed with a vertical slide groove, the turning wheel being pivotally connected with a second guide roller, the second guide roller being located in the slide groove, the second guide roller being movable in the slide groove along with rotation of the turning wheel to bring the slide seat to displace horizontally; the lift seat being disposed at a distal end of the push board, the lift seat comprising a horizontal platform and a vertical slide board beneath the platform; one side of the main frame being provided with a plurality of rail rollers arranged in left and right rows, the slide board being inserted between the rail rollers, the link pivot portion being pivotally connected to a lower end of the slide board, the lift seat being kept vertically on the rail rollers to ascend and descend, the push board being moved back and forth above the platform; thereby, the outer protrusion of the turning wheel being turned to correspond in position to the first proximity switch, the first guide roller being located at an initial position at the annular indentation section of the guide trough, the link rod enabling the lift seat to ascend for a first mahjong tile to be inputted externally; the outer protrusion of the turning wheel being further turned to correspond in position to the second proximity switch, the first guide roller being located in the annular guide trough, the second guide roller being vertically displaced in the slide groove, the link rod enabling the lift seat to descend for a second mahjong tile to be inputted externally, the second mahjong tile being stacked on the first mahjong tile; the outer protrusion of the turning wheel being further turned and returned from the position of the second proximity switch to the initial position of the first proximity switch, the second guide roller bringing the slide seat and the push board to horizontally slide back and forth and push the stacked mahjong tiles outside.

2. The stacking device for mahjong tiles as claimed in claim 1, wherein the main frame is further coupled with a second fixing frame having a fiber optic sensor, and the fiber optic sensor is located above the platform of the lift seat.

3. The stacking device for mahjong tiles as claimed in claim 2, wherein the slide board is disposed at one side of the platform to extend downward, and a vertical side board is provided at one side of the platform to extend upward, wherein the slide board and the side board are at the same side or opposing sides of the platform.

4. The stacking device for mahjong tiles as claimed in claim 3, wherein a bottom of the main frame is provided with a horizontal fixing board, and the fixing board is coupled on a machine platen.

5. The stacking device for mahjong tiles as claimed in claim 1, wherein two sides of the slide board are formed with rail troughs, and the rail troughs are engaged between the left and right rows of the rail rollers.

6. The stacking device for mahjong tiles as claimed in claim 1, wherein the guide roller pivot portion is disposed close to one side of the retaining pivot portion.

7. The stacking device for mahjong tiles as claimed in claim 6, wherein the link pivot portion is in the form of a slot.

* * * * *